US008607416B2

(12) United States Patent
Krajenke et al.

(10) Patent No.: US 8,607,416 B2
(45) Date of Patent: Dec. 17, 2013

(54) DECKLID HINGE COUNTERBALANCE SYSTEM WITH A COMBINATION TORQUE ROD AND TORQUE TUBE ASSEMBLY

(75) Inventors: Gary W. Krajenke, Warren, MI (US); Alvin N. Standard, Clarkston, MI (US); Graham S. Foulkes, Washington Township, MI (US)

(73) Assignee: GM Global Technology Operations LLC, Detroit, MI (US)

( * ) Notice: Subject to any disclaimer, the term of this patent is extended or adjusted under 35 U.S.C. 154(b) by 71 days.

(21) Appl. No.: 13/442,920

(22) Filed: Apr. 10, 2012

(65) Prior Publication Data

US 2013/0263407 A1 Oct. 10, 2013

(51) Int. Cl.
*E05F 1/08* (2006.01)

(52) U.S. Cl.
USPC ..... 16/297; 16/324; 296/146.11

(58) Field of Classification Search
USPC ..... 16/233, 289, 297, 310, 319, 324, 369; 296/146.11
See application file for complete search history.

(56) References Cited

U.S. PATENT DOCUMENTS

| | | | | |
|---|---|---|---|---|
| 2,783,495 | A * | 3/1957 | Vigmostad | 16/308 |
| 3,476,375 | A * | 11/1969 | Brasseur | 267/277 |
| 5,758,389 | A * | 6/1998 | Wolda | 16/308 |
| 5,873,619 | A * | 2/1999 | Lewkoski et al. | 296/76 |
| 7,350,845 | B1 * | 4/2008 | Duffy | 296/76 |
| 7,469,953 | B2 * | 12/2008 | Heath et al. | 296/76 |
| 7,536,748 | B2 * | 5/2009 | Renke et al. | 16/289 |
| 7,841,051 | B2 * | 11/2010 | Wu | 16/337 |
| 2005/0230578 | A1 | 10/2005 | Stockton | |

* cited by examiner

*Primary Examiner* — Roberta Delisle
(74) *Attorney, Agent, or Firm* — Quinn Law Group, PLLC

(57) ABSTRACT

A decklid hinge assembly for a vehicle includes a counterbalance torque system having a torque storing assembly. The torque storing assembly includes a torque rod having a first axial end and a second axial end, and a torque tube having a first axial end and a second axial end. The first axial end of the torque rod is attached to a linkage system in torque transmitting engagement for transmitting torque therebetween, the second axial end of the torque rod is attached to the second axial end of the torque tube in torque transmitting engagement for transmitting torque therebetween, and the first axial end of the torque tube is attached to a hinge box in torque transmitting engagement for transmitting torque therebetween. The torque storing assembly is pre-loaded with a moment to generate a torque for assisting movement of the support member from a closed position into an open position.

19 Claims, 6 Drawing Sheets

DECKLID HINGE COUNTERBALANCE SYSTEM WITH A COMBINATION TORQUE ROD AND TORQUE TUBE ASSEMBLY

TECHNICAL FIELD

The invention generally relates to a hinge assembly for rotatably supporting a decklid of a vehicle, and more specifically to a counterbalanced torque system having a torque storing assembly attached to a hinge box for applying an opening force to the decklid.

BACKGROUND

Counterbalanced decklid hinge assemblies typically include at least one torque rod that extends between a pair of hinge boxes. A support member is rotatably attached to and supported by each of the hinge boxes. One end of the torque rod is bent to define a wind-up end that engages one of the hinge boxes, and the other end of the torque rod is bent to define a looped end that engages one of the support members. The torque rod is twisted during assembly and secured in a position relative to the hinge box to pre-load the torque rod. The pre-loaded torque rod acts as a spring to untwist, thereby applying a torque to the support member to assist in opening the decklid.

The amount of torque that the torque rod is capable of storing is dependent upon the length of the torque rod, with the bent ends of the torque rod reducing the overall effective length of the torque rod. Furthermore, the bent ends of the torque rod induce bending stresses into the torque rod, which decreases the durability of the torque rod. Additionally, such a configuration of the torque rod only allows for a single torque wind up position, thereby limiting the amount of torque that may be pre-loaded into the torque rod. A limited amount of variability may be built into the system by adding different attachment positions to the hinge box to which the wind-up end of the torque rod is attached. However, due to packaging constraints, these variable wind-up positions are only able to provide a range of between 3° and 4° of torque rod rotation.

SUMMARY

A decklid hinge assembly for a vehicle is provided. The decklid hinge assembly includes a hinge box configured for attachment to the vehicle, and a support member rotatably attached to the hinge box. The support member is rotatable about a rotation axis between a closed position and an open position. The decklid hinge assembly further includes a counterbalanced torque system. The counterbalanced torque system includes a linkage system that interconnects the hinge box and the support member. A torque storing assembly is coupled to the hinge box and the linkage system. The torque storing assembly is pre-loaded with a moment to generate a torque for assisting the movement of the support member from the closed position toward the open position. The torque storing assembly includes a torque rod having a first axial end and a second axial end, and a torque tube having a first axial end and a second axial end. The first axial end of the torque rod is attached to the linkage system in torque transmitting engagement for transmitting torque therebetween. The second axial end of the torque rod is attached to the second axial end of the torque tube in torque transmitting engagement for transmitting torque therebetween, and the first axial end of the torque tube is attached to the hinge box in torque transmitting engagement for transmitting torque therebetween.

Accordingly, the torque storing assembly may include a total effective length that is equal to the sum of an effective length of the torque tube and an effective length of the torque rod. The effective length of each of the torque tube and the torque rod are limited by the width of the vehicle. Accordingly, the total effective length of the torque storing assembly may nearly equal twice the width of the vehicle, which is nearly double the effective length of prior art torque rods. The increased total effective length reduces stresses within the torque rod and the torque tube, thereby improving the durability thereof.

The above features and advantages and other features and advantages of the present invention are readily apparent from the following detailed description of the best modes for carrying out the invention when taken in connection with the accompanying drawings.

DETAILED DESCRIPTION

Those having ordinary skill in the art will recognize that terms such as "above," "below," "upward," "downward," "top," "bottom," etc., are used descriptively for the figures, and do not represent limitations on the scope of the invention, as defined by the appended claims.

Figure 1:
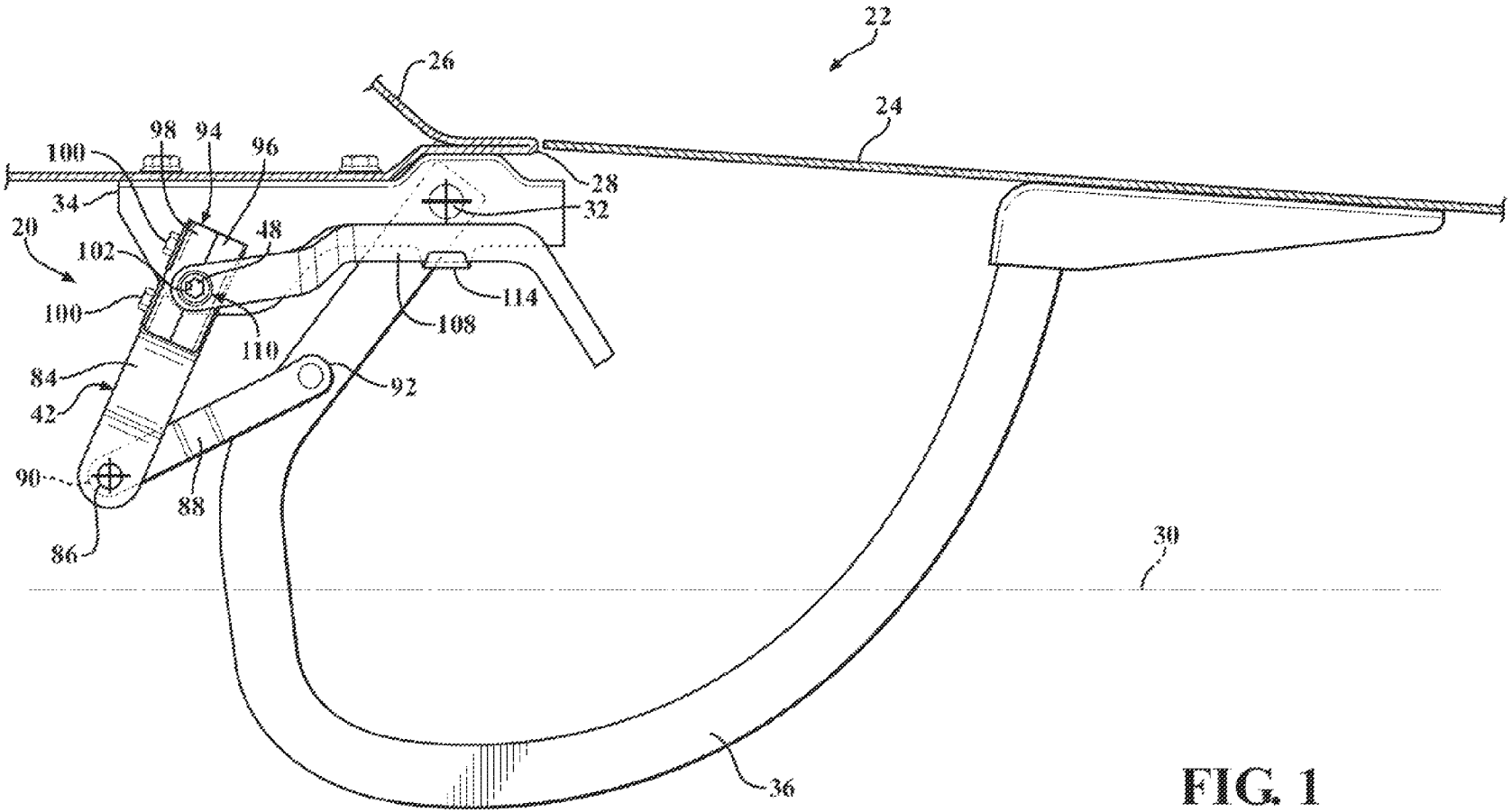
FIG. 1 is a schematic cross sectional view from a side of a vehicle showing a hinge assembly.

Referring to the Figures, wherein like numerals indicate like parts throughout the several views, a decklid hinge assembly, hereinafter referred to as the hinge assembly, is generally shown at 20. Referring to FIG. 1, the hinge assembly 20 is for a vehicle 22, and rotatably couples a decklid 24 to a body 26 of the vehicle 22. The decklid 24 seals an opening 28 defined by the body 26, such as for example, a trunk or cargo area of the vehicle 22. While only a single hinge assembly 20 is shown and described herein, it should be appreciated that the vehicle 22 may include a pair of hinge assemblies, one each on opposing lateral sides of the vehicle 22, with each of the hinge assemblies being mirror images of each other and not directly connected to each other.

The body 26 extends along a longitudinal axis 30 between a forward end and a rearward end. The hinge assembly 20 rotatably attaches the decklid 24 to the body 26 for rotation about a rotation axis 32. As shown, the rotation axis 32 is perpendicular relative to the longitudinal axis 30 of the vehicle 22. However, the relative positions between the rotation axis 32 and the longitudinal axis 30 of the vehicle 22 may differ from that shown and described herein. The decklid 24 is rotatable between a closed position for sealing the opening 28, and an open position for allowing access to the opening 28.

Figure 2:
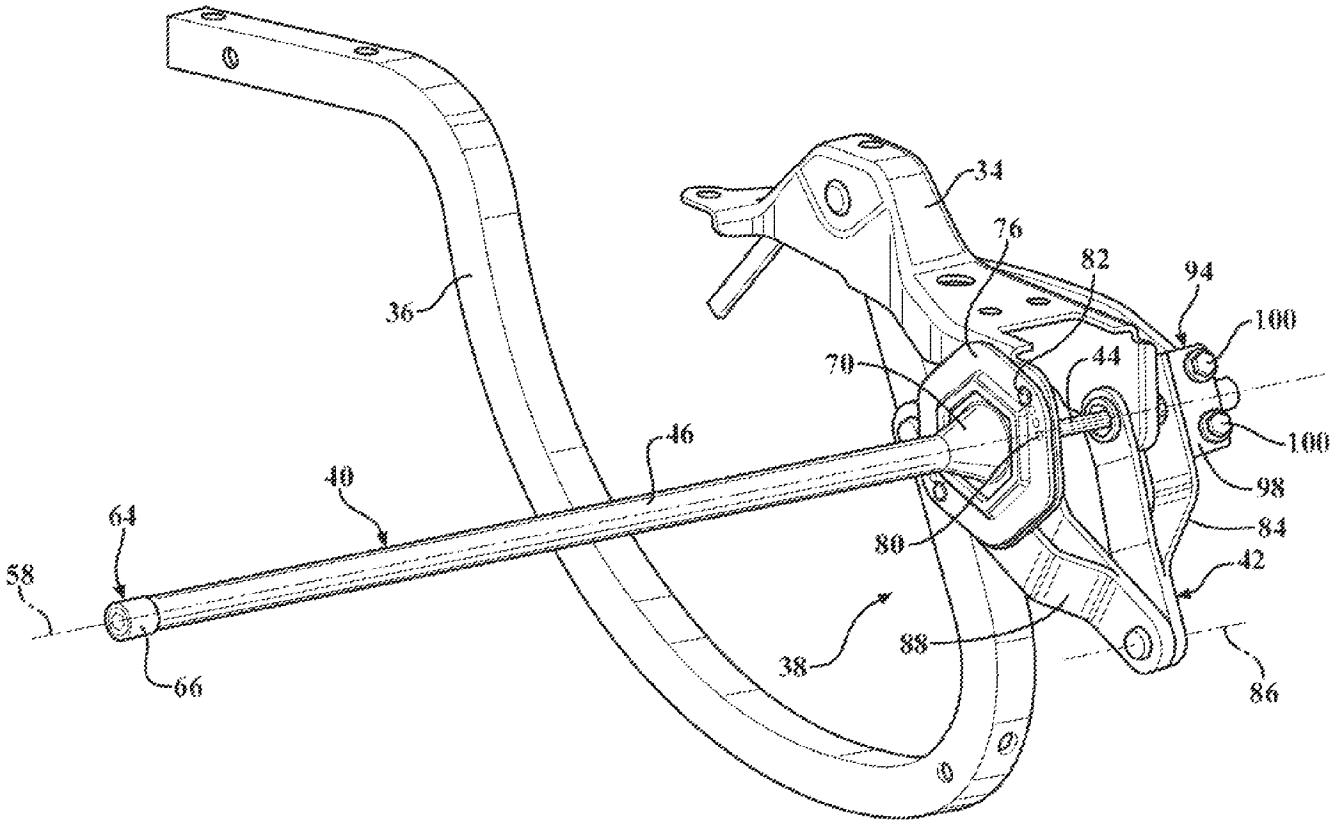
FIG. 2 is a schematic perspective view of the hinge assembly from a first angle.
Figure 3:
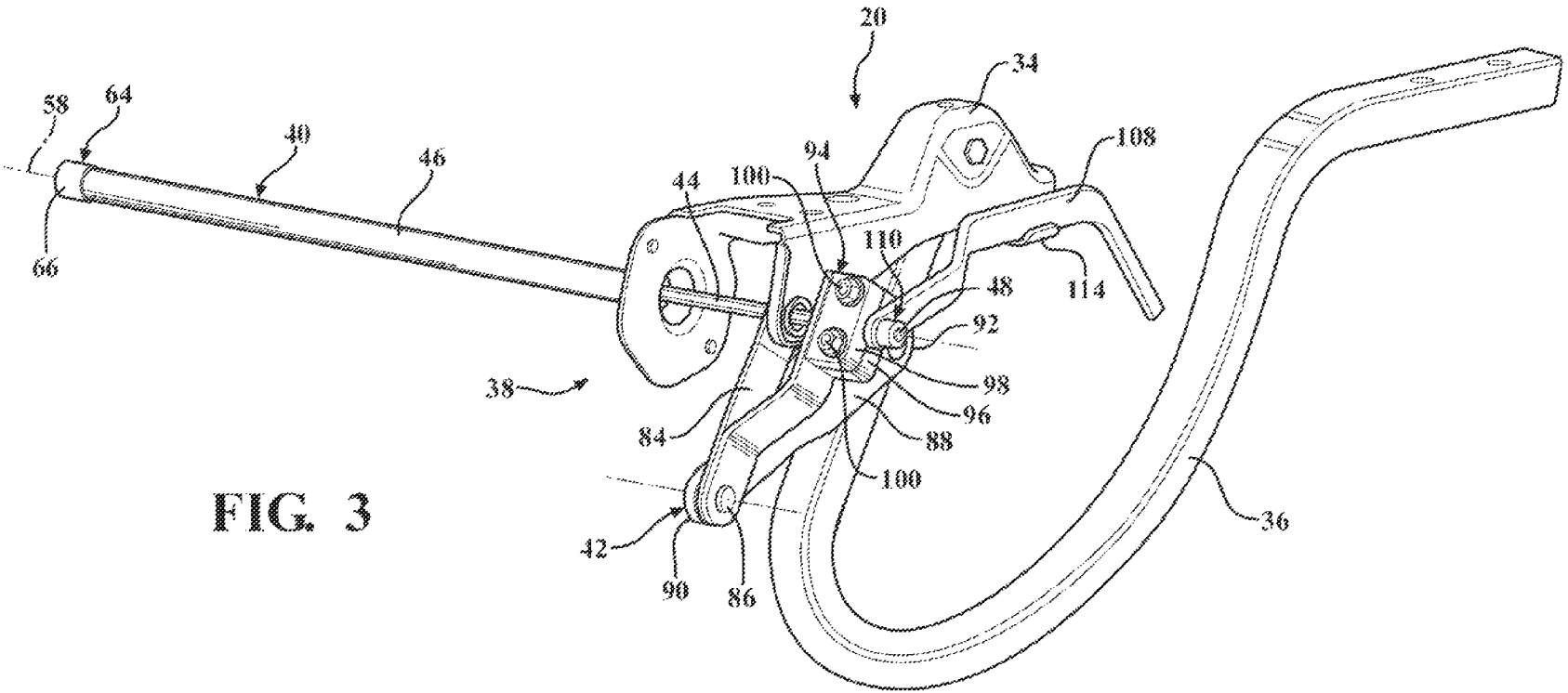
FIG. 3 is a schematic perspective view of the hinge assembly from a second angle.
Figure 4:
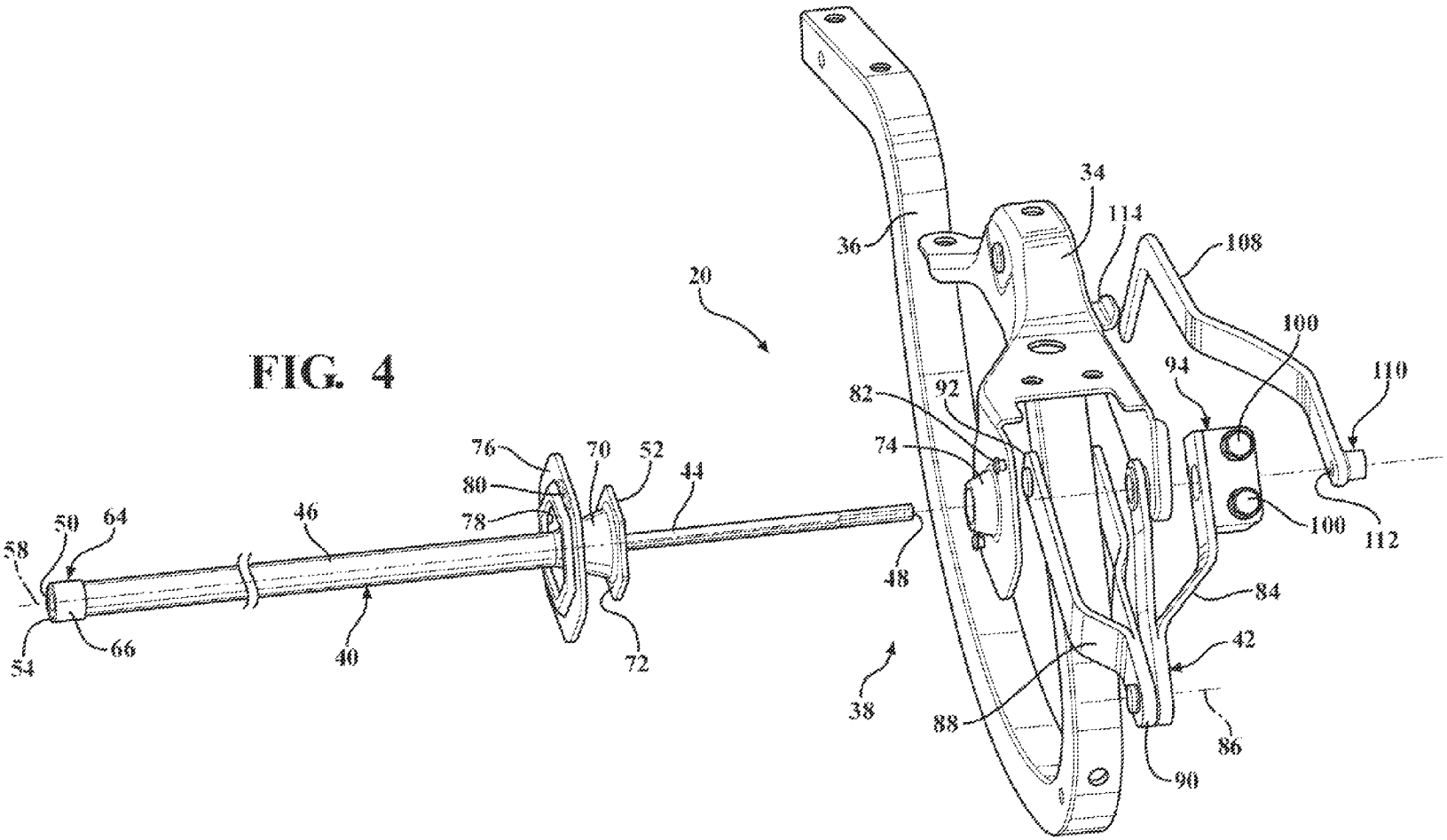
FIG. 4 is a schematic exploded perspective view of the hinge assembly.

Referring also to FIGS. 2 through 4, the hinge assembly 20 includes a hinge box 34. The hinge box 34 is attached to the body 26. The hinge box 34 may be attached to the body 26 in any suitable fashion, such as for example, with fasteners such as bolts and/or screws. A support member 36 is rotatably attached to the hinge box 34. The support member 36 is attached to and supports the decklid 24 relative to the body 26. The support member 36 is configured for rotation about the rotation axis 32 between the closed position and the open position to rotate the decklid 24 between the closed position and the open position. The support member 36 may be shaped in any suitable manner, such as but not limited to the gooseneck configuration shown in the Figures.

The hinge assembly 20 includes a torque counterbalance system 38 that is configured to apply torque to the support member 36 to assist movement of the support member 36 and the decklid 24 from the closed position into the open position. The torque counterbalance system 38 includes a torque storing assembly 40 and a linkage system 42. The torque storing assembly 40 is coupled to and interconnects the hinge box 34 and the linkage system 42. The torque storing assembly 40 is pre-loaded with a moment to generate a torque for assisting the movement of the support member 36 from the closed position into the open position.

The torque storing assembly 40 includes a torque rod 44 and a torque tube 46. The torque rod 44 includes a first axial end 48 and a second axial end 50. Similarly, the torque tube 46 also includes a first axial end 52 and a second axial end 54. The first axial end 48 of the torque rod 44 is attached to the linkage system 42 in torque transmitting engagement for transmitting torque therebetween. The second axial end 50 of the torque rod 44 is attached to the second axial end 54 of the torque tube 46 in torque transmitting engagement for transmitting torque therebetween. The first axial end 52 of the torque tube 46 is attached to the hinge box 34 in torque transmitting engagement for transmitting torque therebetween.

The torque tube 46 defines a hollow interior 56, with the torque rod 44 disposed within the hollow interior 56 of the torque tube 46. The torque rod 44 and the torque tube 46 each include a section modulus. The section modulus of the torque rod 44 and the section modules of the torque tube 46 are designed so that each will generate a similar torque when rotated at approximately the same rate so that neither the torque rod 44 nor the torque tube 46 will yield before the other under a torsional load. As such, the section modulus of the torque tube 46 and the section modules of the torque rod 44 are preferably disposed within a range of between 0% and 10% of each other. Accordingly, it should be appreciated that the torque rod 44 and the torque tube 46 may have the same section modulus, wherein the difference between the section modulus of the torque tube 46 and the section modulus of the torque rod 44 is 0%. Furthermore, it should be appreciated that the section modulus of one of the torque tube 46 and the torque rod 44 may differ by up to 10% greater than or less than the section modulus of the other.

Each of the torque rod 44 and the torque tube 46 define a linear shape that extends along a rod axis 58. The torque rod 44 and the torque tube 46 each extend along the linear rod axis 58 without any bends therein, with the first axial end 48 and the second axial end 50 of the torque rod 44, and the first axial end 52 and the second axial end 54 of the torque tube 46 disposed along the rod axis 58. The torque rod 44 and the torque tube 46 are co-axially aligned along the rod axis 58.

Figure 6:
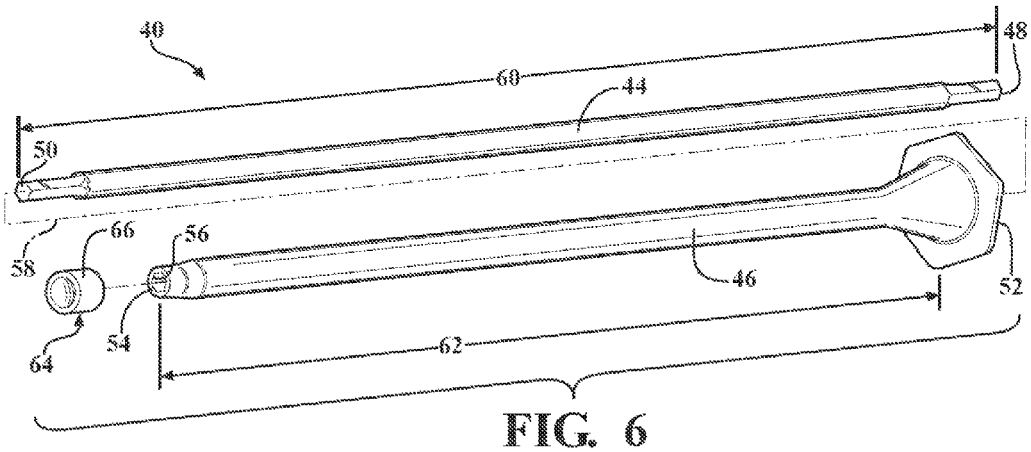
FIG. 6 is a schematic exploded perspective view of the torque storing assembly.

Referring to FIG. 6, the torque storing assembly 40 defines a total effective torque length that is comprised of the sum of an effective torque length 60 of the torque rod 44 and the effective torque length 62 of the torque tube 46. The effective torque length 60 of the torque rod 44 and the effective torque length 62 of the torque tube 46 are limited by a width of the vehicle 22 measured transverse to the longitudinal axis 30 of the vehicle 22. Accordingly, the total effective torque length of the torque storing assembly 40 may be as large as nearly twice the width of the vehicle 22. Larger values of the total effective torque length of the torque storing assembly 40 decrease the stresses on the torque rod 44 and the torque tube 46, thereby improving durability of the torque storing assembly 40.

Figure 7:
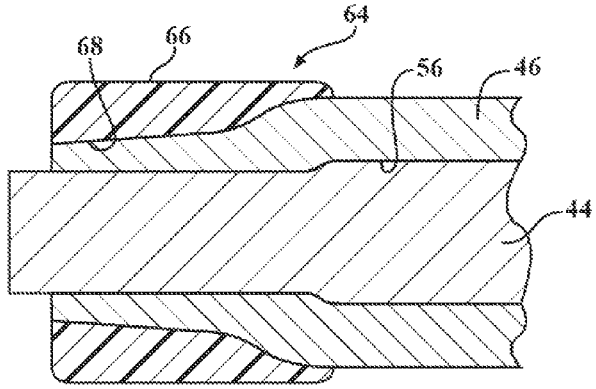
FIG. 7 is a schematic fragmentary cross sectional view of the torque storing assembly.

As described above, the second axial end 50 of the torque rod 44 is attached to the second axial end 54 of the torque tube 46 in torque transmitting engagement for transmitting torque therebetween. The second axial end 50 of the torque rod 44 may be attached to the second axial end 54 of the torque tube 46 in any suitable manner. For example, referring to FIGS. 6 and 7, the second axial end 50 of the torque rod 44 defines an exterior cross sectional shape, and the hollow interior 56 of the torque tube 46 defines an interior cross sectional shape that is configured for receiving the exterior cross sectional shape of the torque rod 44 in interlocking rotational engagement. The exterior cross sectional shape of the torque rod 44 and the interior cross sectional shape of the torque tube 46 each include a hexagonal shape. A locking device 64 secures the second axial end 54 of the torque tube 46 relative to the second axial end 50 of the torque rod 44 to prevent relative axial movement between the torque rod 44 and the torque tube 46 along the rod axis 58. The locking device 64 includes a sleeve 66 disposed over an exterior surface of the second end 50 of the torque tube 46. The locking device 64 is configured to compress the torque tube 46 inward against the torque rod 44. One of the outer surface of the torque tube 46 or an inner surface of the sleeve 66 may define an angled surface 68 relative to the rod axis 58 that is configured to wedge the sleeve 66 in place relative to the torque tube 46. As shown, the inner surface of the sleeve 66 defines the angled surface 68. It should be appreciated that the torque transmitting engagement between the second axial end 50 of the torque rod 44 and the second axial end 54 of the torque tube 46 that is described above is merely exemplary, and may differ from that shown and described herein.

Figure 5:
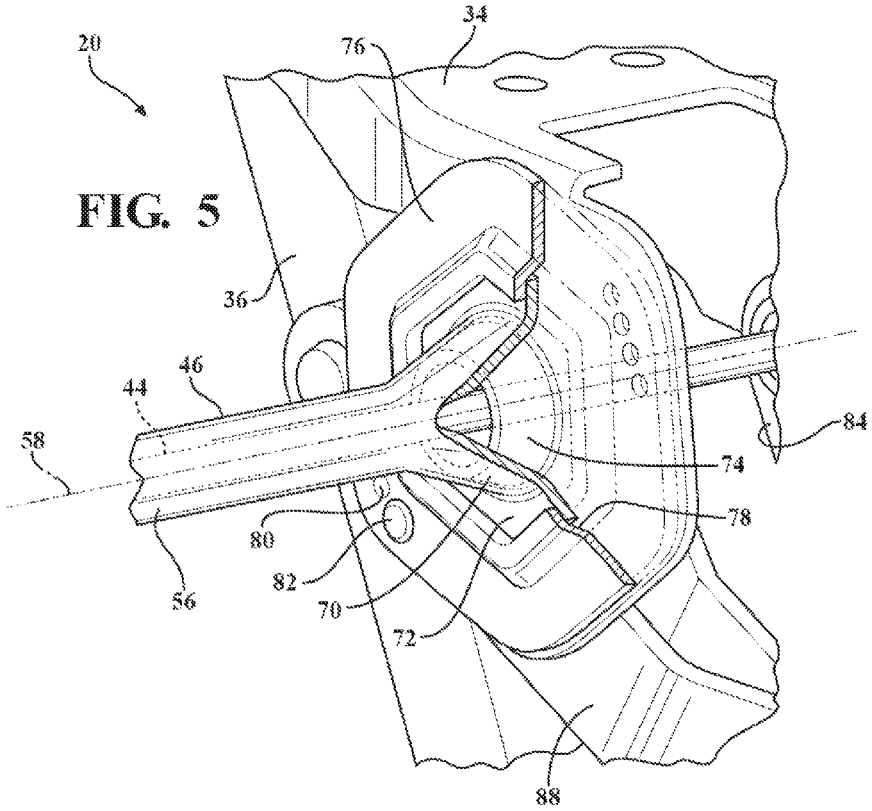
FIG. 5 is a schematic fragmentary perspective view of the hinge assembly showing a connection between a torque storing assembly and a hinge box.

As described above, the first axial end 52 of the torque tube 46 is attached to the hinge box 34 in torque transmitting engagement for transmitting torque therebetween. The first axial end 52 of the torque tube 46 may be attached to the hinge box 34 in any suitable manner. For example, referring to FIGS. 2, 4 and 5, the first axial end 52 of the torque tube 46 is flared to define a conical section 70 having a radially extending flange 72. The hinge box 34 includes a conical extension 74 having an exterior shape and size corresponding to an interior shape and size of the conical section 70 of the torque tube 46. The conical extension 74 engages the conical section 70 to align and position the first axial end 52 of the torque tube 46 relative to the hinge box 34 and the rod axis 58. As shown, a cap 76 interconnects the first axial end 52 of the torque tube 46 and the hinge box 34. The cap 76 is coupled to the flange 72 of the conical section 70 in interlocking engagement to prevent relative rotation between the cap 76 and the torque tube 46 about the rod axis 58. For example, the flange 72 may define a non-circular perimeter that is radially spaced from the rod axis 58, such as the hexagonal shape shown. The cap 76 defines a similarly sized and shaped recess 78 for receiving the flange 72 therein. Once the cap 76 is secured to the hinge box 34 with the flange 72 positioned within the recess 78, the torque tube 46 is rotationally fixed relative to the cap 76 and the hinge box 34 against rotation about the rod axis 58. It should be appreciated that the torque transmitting engagement between the first axial end 52 of the torque tube 46 and the hinge box 34 that is described above is merely exemplary, and may differ from that shown and described herein.

The cap 76 may include a plurality of apertures 80 disposed about a periphery of the cap 76 equidistant from the rod axis 58, and the hinge box 34 may include at least one projection 82 extending through one of the plurality of apertures 80. As shown, the hinge box 34 includes two projections 82 spaced one hundred eighty degrees (180°) apart about the rod axis 58, and the cap 76 defines six apertures 80 comprised of three sets of two apertures 80, with each set of two apertures 80 spaced one hundred eighty degrees (180°) apart about the rod axis 58. The projections 82 are positionable within any of the three sets of two apertures 80 to adjust the rotational position of the cap 76 relative to the hinge box 34 about the rod axis 58. Adjusting the rotational position of the torque tube 46 relative to the hinge box 34 affects the torque output of the torque storing assembly 40. Accordingly, the variable positions provided by the projections 82 being positioned in the different apertures 80 provides adjustability to the torque output of the torque storing assembly 40.

Referring to FIGS. 2 through 4, the linkage system 42 interconnects the hinge box 34 and the support member 36. Additionally, the linkage system 42 interconnects the first axial end 48 of the torque rod 44 and the support member 36. The linkage system 42 transfers a torque from the torque storing assembly 40 to the support member 36. The torque applied to the support member 36 assists the movement of the support member 36 from the closed position into the open position. The linkage system 42 includes a wind-up link 84 that is attached to and rotatable with the torque rod 44. The wind-up link 84 extends radially away from the rod axis 58 to a distal pivot point 86, which is laterally spaced from the rod axis 58. The linkage system 42 further includes a driven link 88 having a first end 90 rotatable coupled to the wind-up link 84 at the pivot point 86, and a second end 92 rotatably coupled to the support member 36.

Figure 8:
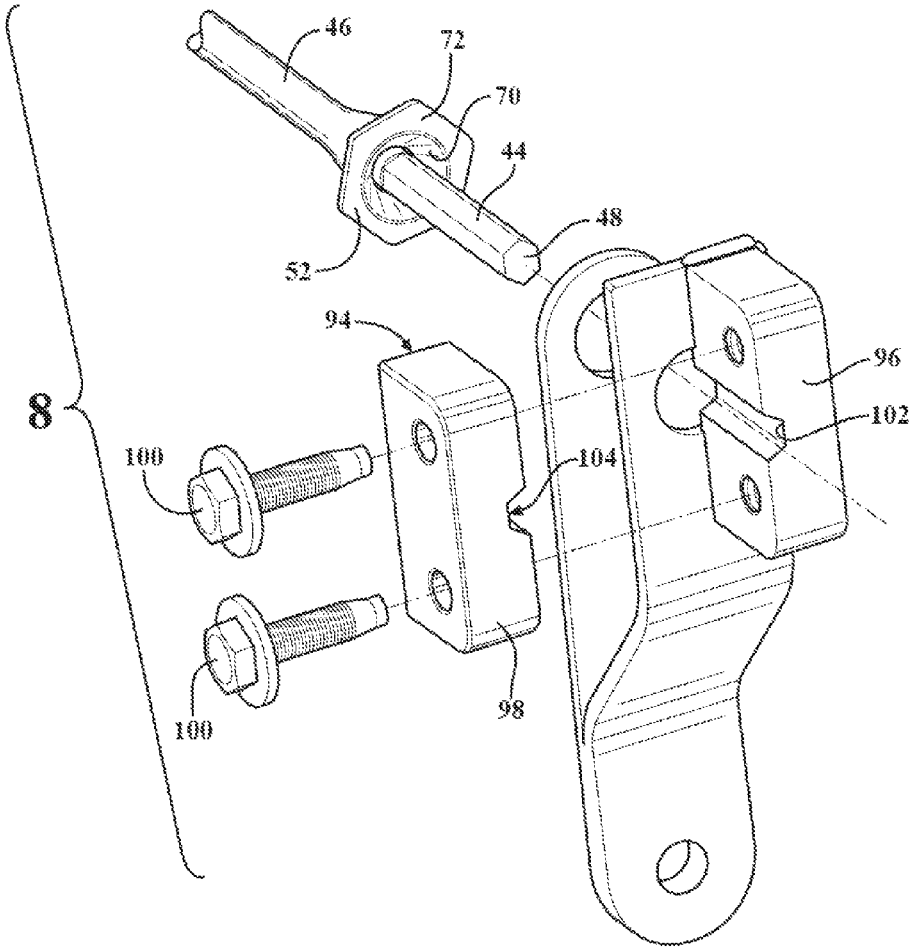
FIG. 8 is a schematic exploded partial view of a clamping block.

As described above, the first axial end 48 of the torque rod 44 is attached to the linkage system 42 in torque transmitting engagement for transmitting torque therebetween. The first axial end 48 of the torque rod 44 may be attached to the hinge box 34 in any suitable manner. For example, referring to FIGS. 3 and 8, a clamping block 94 is fixedly attached to the linkage system 42 and positionally and rotationally secures the first axial end 48 of the torque rod 44 to the linkage system 42 at any relative rotational position therebetween. The clamping block 94 includes a first portion 96 fixedly attached to the wind-up link 84, and a second portion 98 attached to the first portion 96. A fastening mechanism attaches the second portion 98 to the first portion 96. The fastening mechanism may include any device capable of securing the second portion 98 to the first portion 96 with enough clamping force therebetween to positionally secure the torque rod 44, therebetween. For example, the fastening mechanism may include at least one fastener 100 extending through the second portion 98 and into threaded engagement with the first portion 96. Two fasteners 100 are shown in the Figures. Alternatively, it is contemplated that some other fastening mechanism not shown or described herein may be employed, such as, for example, a cam and lever system.

The first portion 96 and the second portion 98 cooperate to define an annular passage 102 therebetween. As shown, each of the first portion 96 and the second portion 98 define a semi-circular recess 78, that when joined together, form the annular passage 102. The annular passage 102 receives the torque rod 44 therethrough with the first portion 96 and the second portion 98 drawn together by the fastening mechanism to provide a clamping force against the torque rod 44 to secure the torque rod 44 in place relative to the clamping block 94.

The annular passage 102 includes an anti-rotation feature 104 for frictionally engaging the torque rod 44. The anti-rotation feature 104 engages the torque rod 44, disposed within the annular passage 102, to prevent rotation of the torque rod 44 relative to the clamping block 94 when the second portion 98 is attached to and clamped against the first portion 96. The anti-rotation feature 104 may include, for example, a plurality of deformations, such as but not limited to a plurality of ridges extending along a central axis parallel to the torque rod 44 and extending radially inward toward the torque rod 44. Alternatively and as shown, the anti-rotation feature 104 may include a corresponding non-circulate shape shared between the first axial end 48 of the torque rod 44 and the annular passage 102 of the clamping block 94. The anti-rotation feature 104 engages the torque rod 44, and increases the friction therebetween when the first portion 96 is clamped against the second portion 98 to prevent rotation of the torque rod 44 relative to the clamping block 94. It should be appreciated that the torque transmitting engagement between the first axial end 48 of the torque rod 44 and the linkage system 42 that is described above is merely exemplary, and may differ from that shown and described herein.

As best shown in FIG. 3, the first axial end 48 of the torque rod 44 is disposed outboard of the clamping block 94. As used herein, the term outboard is defined as disposed farther from the longitudinal axis 30. Accordingly, the first axial end 48 of the torque rod 44 is disposed farther from the longitudinal axis 30 than the clamping block 94. A lever 108 may be attached to and rotatable with the first axial end 48 of the torque rod 44. The lever 108 is rotationally fixed relative to the first axial end 48 of the torque rod 44 such that rotation of the lever 108 rotates the torque rod 44.

The lever 108 may include a rotational locking mechanism 110 rotationally securing the lever 108 to the torque rod 44. The rotational locking mechanism 110 may include any mechanism capable of rotationally securing the lever 108 to the torque rod 44, while maintaining the straight axial orientation of the torque rod 44. In other words, the rotational locking mechanism 110 rotationally secures the lever 108 to the torque rod 44 without bending the first axial end 48 of the torque rod 44. For example, referring to FIGS. 3 and 4, the rotational locking mechanism 110 may include a lever aperture 112 having a non-annular cross sectional shape corresponding to a non-annular cross sectional shape of the first axial end 48 of the torque rod 44. For example, the lever aperture 112 may define a hexagonal cross sectional shape that mates with a hexagonal exterior shape of the first axial end 48 of the torque rod 44. However, it should be appreciated that other non-annular corresponding shapes between the lever aperture 112 and the torque rod 44 may alternatively be used.

The torque storing assembly 40 is twisted by rotation of the lever 108 about the rod axis 58 to generate the torque that is stored within the torque storing assembly 40. During assembly, the lever 108 is rotated into position and secured in that position relative to the hinge box 34. This rotation, about the rod axis 58, twists the torque storing assembly 40 between the first axial end 48 of the torque rod 44, secured to the linkage system 42, and the first axial end 52 of the torque tube 46, secured to the hinge box 34, thereby generating the torque used to assist in opening 28 the decklid 24. The hinge box 34 includes a retention feature 114 that is configured for securing the lever 108 in position relative to the hinge box 34. The retention feature 114 prevents the rotation of the lever 108 in a direction that would allow the torque storing assembly 40 to untwist, and also resists lateral movement away from the longitudinal axis 30 to prevent unintentional disengagement of the lever 108 from the retention feature 114.

The detailed description and the drawings or figures are supportive and descriptive of the invention, but the scope of the invention is defined solely by the claims. While some of the best modes and other embodiments for carrying out the claimed invention have been described in detail, various alternative designs and embodiments exist for practicing the invention defined in the appended claims.

The invention claimed is:

1. A hinge assembly for a vehicle, the decklid hinge assembly comprising:

a hinge box configured for attachment to the vehicle;

a support member rotatably attached to the hinge box for rotation about a rotation axis between a closed position and an open position; and a counterbalance torque system including:

a linkage system interconnecting the hinge box and the support member; and a torque storing assembly coupled to the hinge box and the linkage system and pre-loaded with a moment to generate a torque for assisting the movement of the support member from the closed position toward the open position;

wherein the torque storing assembly includes a torque rod having a first axial end and a second axial end, and a torque tube having a first axial end and a second axial end;

wherein the torque tube defines a hollow interior with the torque rod disposed within the hollow interior; and wherein the first axial end of the torque rod is attached to the linkage system in torque transmitting engagement for transmitting torque therebetween, the second axial end of the torque rod is attached to the second axial end of the torque tube in torque transmitting engagement for transmitting torque therebetween, and the first axial end of the torque tube is attached to the hinge box in torque transmitting engagement for transmitting torque therebetween.

2. A hinge assembly as set forth in claim 1 wherein the torque rod and the torque tube each include a section modulus within a range of between 0% and 10% of each other.

3. A hinge assembly as set forth in claim 1 wherein each of the torque rod and the torque tube define a linear shape extending along a rod axis.

4. A hinge assembly as set forth in claim 3 wherein the torque rod and the torque tube are co-axially aligned along the rod axis.

5. A hinge assembly as set forth in claim 1 wherein the first axial end of the torque tube is flared to define a conical section having a radially extending flange.

6. A hinge assembly as set forth in claim 5 wherein the hinge box includes a conical extension having an exterior shape and size corresponding to an interior shape and size of the conical section of the torque tube for mating engagement therewith to align and position the first axial end of the torque tube relative to the hinge box and the rod axis.

7. A hinge assembly as set forth in claim 6 further comprising a cap interconnecting the first axial end of the torque tube and the hinge box.

8. A hinge assembly as set forth in claim 7 wherein the cap is coupled to the flange of the conical section in interlocking engagement to prevent relative rotation between the cap and the torque tube.

9. A hinge assembly as set forth in claim 8 wherein the cap includes a plurality of apertures disposed about a periphery of the cap equidistant from the rod axis and the hinge box includes at least one projection extending through one of the plurality of apertures, wherein the at least one projection is positionable within any of the plurality of apertures to adjust the rotational position of the cap relative to the hinge box about the rod axis to affect torque output of the torque storing assembly.

10. A hinge assembly as set forth in claim 1 wherein the second axial end of the torque rod defines an exterior cross sectional shape and the hollow interior of the torque tube defines an interior cross sectional shape configured for receiving the exterior cross sectional shape of the torque rod in interlocking rotational engagement.

11. A hinge assembly as set forth in claim 10 wherein the exterior cross sectional shape of the torque rod and the interior cross sectional shape of the torque tube each include a hexagonal shape.

12. A hinge assembly as set forth in claim 1 further comprising a locking device configured to secure the second axial end of the torque tube relative to the second axial end of the torque rod to prevent relative axial movement between the torque rod and the torque tube along the rod axis.

13. A hinge assembly as set forth in claim 12 wherein the locking device includes a sleeve disposed over an exterior surface of the second end of the torque tube and configured to compress the torque tube inward against the torque rod.

14. A hinge assembly as set forth in claim 13 wherein one of the torque tube and the sleeve defines an angled surface configured to wedge the sleeve in place relative to the torque tube.

15. A hinge assembly as set forth in claim 1 wherein the torque storing assembly defines a total effective torque length comprised of the sum of an effective torque length of the torque rod and the effective torque length of the torque tube.

16. A hinge assembly for a vehicle, the decklid hinge assembly comprising:

a hinge box configured for attachment to the vehicle;

a support member rotatably attached to the hinge box for rotation about a rotation axis between a closed position and an open position; and a counterbalance torque system including:

a linkage system interconnecting the hinge box and the support member; and a torque storing assembly coupled to the hinge box and the linkage system and pre-loaded with a moment to generate a torque for assisting the movement of the support member from the closed position toward the open position;

wherein the torque storing assembly includes a torque rod having a first axial end and a second axial end, and a torque tube having a first axial end and a second axial end;

wherein the torque tube defines a hollow interior with the torque rod disposed within the hollow interior;

wherein the torque rod and the torque tube are co-axially aligned along the rod axis; and wherein the first axial end of the torque rod is attached to the linkage system in torque transmitting engagement for transmitting torque therebetween, the second axial end of the torque rod is attached to the second axial end of the torque tube in torque transmitting engagement for transmitting torque therebetween, and the first axial end of the torque tube is attached to the hinge box in torque transmitting engagement for transmitting torque therebetween.

17. A hinge assembly as set forth in claim 16 wherein the torque rod and the torque tube each include a section modulus within a range of between 0% and 10% of each other.

18. A hinge assembly as set forth in claim 16 wherein:

the first axial end of the torque tube is flared to define a conical section having a radially extending flange; and wherein the hinge box includes a conical extension having an exterior shape and size corresponding to an interior shape and size of the conical section of the torque tube for mating engagement therewith to align and position the first axial end of the torque tube relative to the hinge box and the rod axis.

19. A hinge assembly as set forth in claim 18 further comprising:

a cap interconnecting the first axial end of the torque tube and the hinge box;

wherein the cap is coupled to the flange of the conical section in interlocking engagement to prevent relative rotation between the cap and the torque tube;

wherein the cap includes a plurality of apertures disposed about a periphery of the cap equidistant from the rod axis and the hinge box includes at least one projection extending through one of the plurality of apertures; and wherein the at least one projection is positionable within any of the plurality of apertures to adjust the rotational position of the cap relative to the hinge box about the rod axis to affect torque output of the torque storing assembly.

* * * * *